US012110651B2

(12) United States Patent
Yamawaki et al.

(10) Patent No.: US 12,110,651 B2
(45) Date of Patent: Oct. 8, 2024

(54) WORK MACHINE AND METHOD FOR CONTROLING WORK MACHINE

(71) Applicant: KOMATSU LTD., Tokyo (JP)

(72) Inventors: Shota Yamawaki, Tokyo (JP); Shogo Miyazaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 521 days.

(21) Appl. No.: 17/426,399

(22) PCT Filed: Mar. 18, 2020

(86) PCT No.: PCT/JP2020/012075
§ 371 (c)(1),
(2) Date: Jul. 28, 2021

(87) PCT Pub. No.: WO2020/203315
PCT Pub. Date: Oct. 8, 2020

(65) Prior Publication Data

US 2022/0106763 A1 Apr. 7, 2022

(30) Foreign Application Priority Data

Mar. 29, 2019 (JP) ..... 2019-067317

(51) Int. Cl.
*E02F 3/28* (2006.01)
*E02F 3/42* (2006.01)
(Continued)

(52) U.S. Cl.
CPC ..... *E02F 3/431* (2013.01); *E02F 3/283* (2013.01); *E02F 3/422* (2013.01); *E02F 9/2203* (2013.01);
(Continued)

(58) Field of Classification Search
CPC ..... E02F 9/0841; E02F 9/2271; E02F 9/2228; E02F 9/2203; E02F 3/422; E02F 3/283; E02F 3/431
See application file for complete search history.

(56) References Cited

U.S. PATENT DOCUMENTS

2012/0024146 A1 2/2012 Saito
2013/0000288 A1 1/2013 Ho et al.
(Continued)

FOREIGN PATENT DOCUMENTS

EP 0 623 753 A1 11/1994
EP 2 505 722 A1 10/2012
(Continued)

OTHER PUBLICATIONS

The extended European search report for the corresponding European application No. 20782694.2, issued on Oct. 28, 2022.
(Continued)

*Primary Examiner* — Kenneth Bomberg
*Assistant Examiner* — Daniel S Collins
(74) *Attorney, Agent, or Firm* — Global IP Counselors, LLP

(57) ABSTRACT

A work machine includes a boom, a work tool configured to drive with respect to the boom, an actuator configured to drive the work tool, a sub-link attached to the boom, and a control section. The sub-link is configured to transmit driving force of the actuator to the work tool. The control section is configured to control the actuator based on a posture of the sub-link with respect to the boom. A method of controlling a work machine includes controlling an actuator based on a posture of a sub-link with respect to a boom, the sub-link being configured to transmit driving force of the actuator to a work tool configured to drive with respect to the boom.

8 Claims, 12 Drawing Sheets

(51) Int. Cl.

| | |
|---|---|
| ***E02F 3/43*** | (2006.01) |
| ***E02F 9/22*** | (2006.01) |
| *E02F 9/08* | (2006.01) |
| *E02F 9/20* | (2006.01) |

(52) U.S. Cl.
CPC ..... *E02F 9/2228* (2013.01); *E02F 9/2271* (2013.01); *E02F 9/0841* (2013.01); *E02F 9/2004* (2013.01); *E02F 9/2285* (2013.01); *E02F 9/2292* (2013.01)

(56) References Cited

U.S. PATENT DOCUMENTS

| | | | | |
|---|---|---|---|---|
| 2014/0129093 | A1 | 5/2014 | Shirao et al. | |
| 2016/0002883 | A1 | 1/2016 | Sakon | |
| 2016/0251829 | A1* | 9/2016 | Imaizumi | E02F 9/2296 701/50 |
| 2017/0037594 | A1* | 2/2017 | Wada | E02F 3/43 |
| 2018/0119384 | A1 | 5/2018 | Imaizumi et al. | |

FOREIGN PATENT DOCUMENTS

| | | | |
|---|---|---|---|
| EP | 2 933 384 | A1 | 10/2015 |
| JP | 2001-132009 | A | 5/2001 |
| JP | 2010-203109 | A | 9/2010 |
| JP | 2014-55439 | A | 3/2014 |
| JP | 5717923 | B1 | 5/2015 |
| WO | 2010/110386 | A1 | 9/2010 |
| WO | 2015/083753 | A1 | 6/2015 |
| WO | 2016/006716 | A1 | 1/2016 |
| WO | 2017126182 | A1 | 7/2017 |

OTHER PUBLICATIONS

The Office Action for the corresponding Chinese application No. 202080012824.4, issued on May 18, 2022.
The International Search Report for the corresponding international application No. PCT/JP2020/012075, issued on Jun. 9, 2020.

* cited by examiner

WORK MACHINE AND METHOD FOR CONTROLING WORK MACHINE

CROSS-REFERENCE TO RELATED APPLICATIONS

This application is a U.S. National stage application of International Application No. PCT/JP2020/012075, filed on Mar. 18, 2020. This U.S. National stage application claims priority under 35 U.S.C. § 119(a) to Japanese Patent Application No. 2019-067317, filed in Japan on Mar. 29, 2019, the entire contents of which are hereby incorporated herein by reference.

BACKGROUND

Field of the Invention

The present invention relates to a work machine and a method for controlling a work machine.

Background Information

A wheel loader as an example of a work implement has a work implement with a bucket at the tip of the boom. A hydraulic cylinder for boom is provided between the vehicle body of the wheel loader and the boom, and the boom rotates in the vertical direction due to expansion and contraction of the hydraulic cylinder.

A bell crank is attached to the boom, and a hydraulic cylinder for a bucket is provided between one end of the bell crank and the vehicle body. The other end of the bell crank is attached to the bucket by a rod. When the hydraulic cylinder for the bucket extends, the bucket rotates in the tilt direction, and when the hydraulic cylinder for the bucket contracts, the bucket rotates in the dump direction (see, for example, Japanese Patent laid open No. 5717923).

In such a wheel loader, depending on the boom angle, the bucket reaches the tilt end or the dump end due to the configuration of the work implement linkage before the stroke of the cylinder for the bucket reaches the maximum or minimum value, so that, over the entire boom angle, the maximum stroke of the cylinder for the bucket does not corresponds to the tilt end and the minimum stroke of the cylinder for the bucket does not correspond to the dump end.

Therefore, the impact mitigation control at the tilt end or the dump end is performed based on a map in which the stroke end of the cylinder length in consideration of the bucket shape is defined with respect to the boom angle.

SUMMARY

However, it is required to perform mitigation control without considering the boom angle.

An object of the present invention is to provide a work machine and a method for controlling a work machine capable of mitigating an impact at a tilt end or a dump end without considering a boom angle.

A work machine of the present invention includes a boom, a work tool, an actuator, a sub-link, and a control section. The work tool is configured to drive with respect to the boom. The actuator is configured to drive the work tool. The sub-link is attached to the boom and is configured to transmit the driving force of the actuator to the work tool. The control section controls the actuator based on a posture of the sub-link with respect to the boom.

A method for controlling a work machine of the present invention includes a control step. In the control step, an actuator is controlled based on a posture of a sub-link with respect to a boom. The actuator is configured to transmit driving force of the actuator to a work tool configured to drive the boom.

Effect of the Invention

According to the present invention, it is possible to provide a work implement machine and a method for controlling a work machine capable of mitigating an impact at a tilt end or a dump end without considering a boom angle.

DETAILED DESCRIPTION OF EMBODIMENT(S)

Hereinafter, the wheel loader 1 (an example of a work machine) according to the embodiment of the present invention will be described with reference to the drawings.

Configuration

Outline of Configuration of Wheel Loader 1

Figure 1:
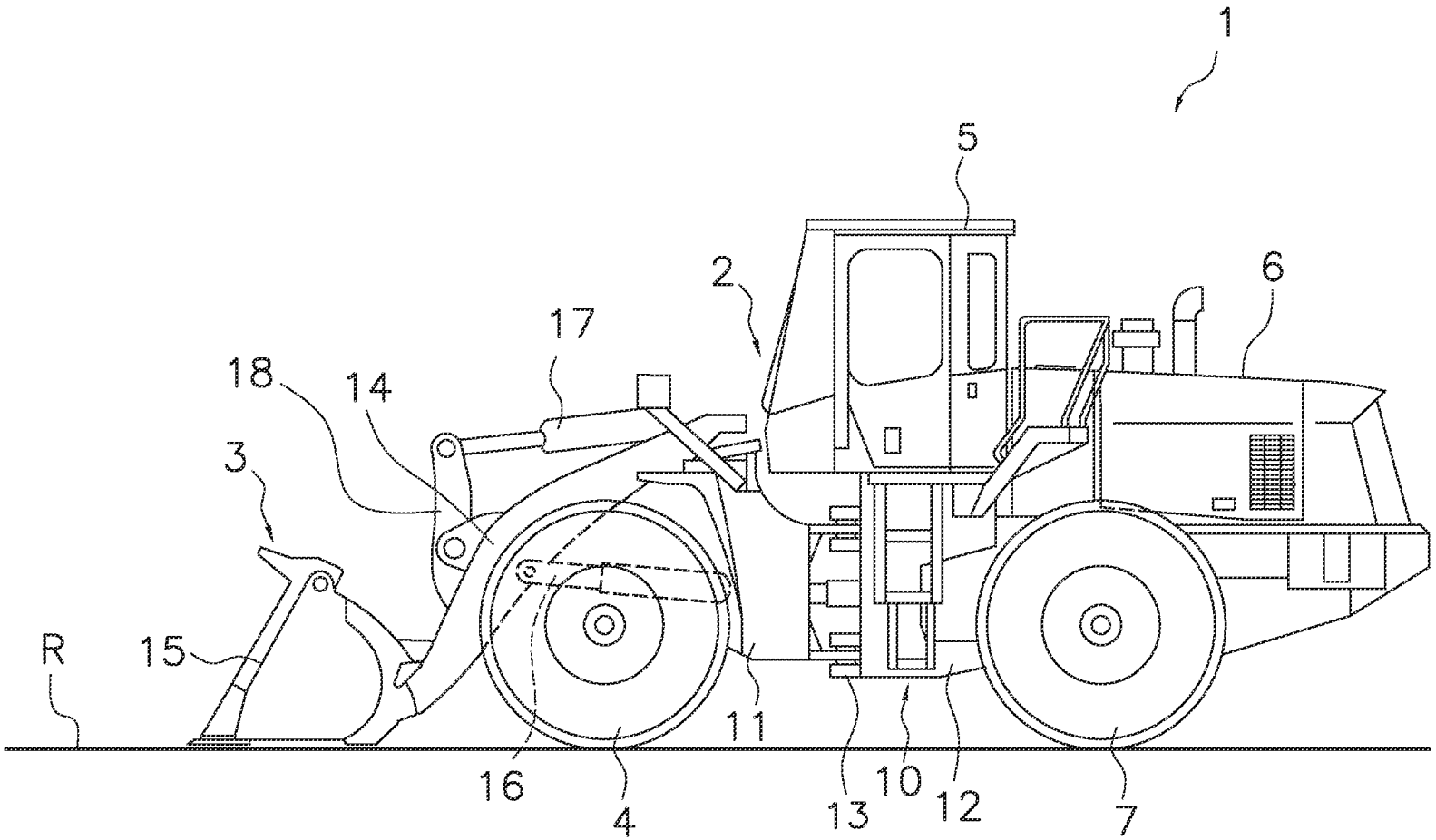
FIG. 1 is a side view of a wheel loader according to an embodiment of the present invention.

FIG. 1 is a schematic view showing the configuration of the wheel loader 1 of the present embodiment.

The wheel loader 1 of the present embodiment includes a vehicle body 2 (an example of a vehicle body) and work implement 3. The vehicle body 2 includes a vehicle body frame 10, a pair of front tires 4, a cab 5, an engine room 6, a pair of rear tires 7, and a control system 8 (see FIG. 3).

The wheel loader 1 uses work implement 3 to perform earth and sand loading work and the like.

The vehicle body frame 10 is a so-called articulated type, and includes a front frame 11, a rear frame 12, and a connecting shaft part 13. The front frame 11 is arranged in front of the rear frame 12. The connecting shaft part 13 is provided at the center in the vehicle width direction, and connects the front frame 11 and the rear frame 12 so as to be swingable to each other.

The cab 5 is provided on the rear frame 12 and a driver's seat is arranged in the cab 5. The cab 5 is provided with an input/output device 50, a boom operating lever 61, a bucket operating lever 62, and the like, which will be described later.

The pair of front tires 4 are attached to the left and right sides of the front frame 11. Further, a pair of rear tires 7 are attached to the left and right sides of the rear frame 12.

Figure 2:
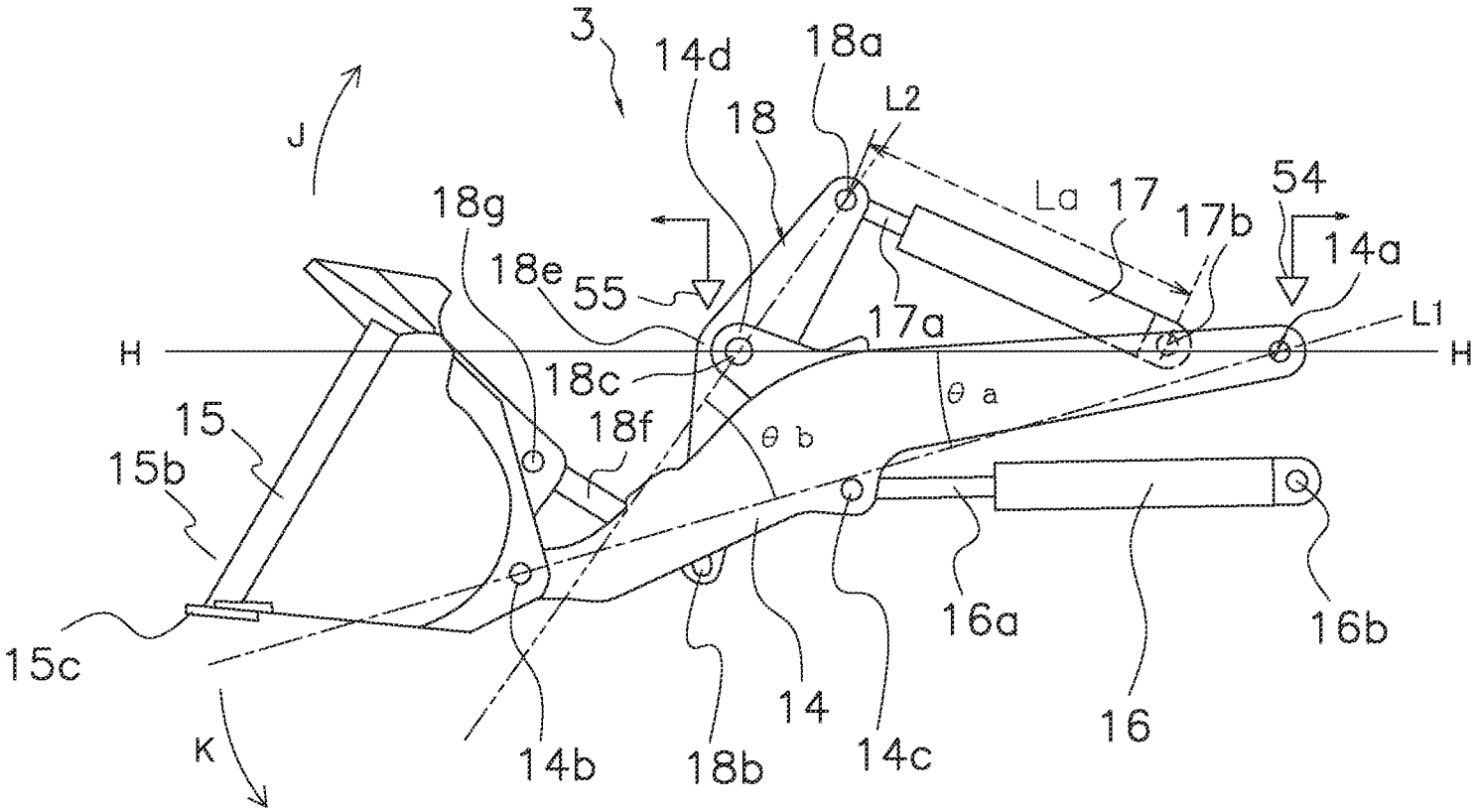
FIG. 2 is a side view of the work machine in FIG. 1.

The work implement 3 is driven by hydraulic fluid from the work implement pump. FIG. 2 is an enlarged side view of work implement 3.

The work implement 3 includes a boom 14, a bucket 15 (an example of a work tool), a boom cylinder 16, a bucket cylinder 17 (an example of an actuator), and a bell crank 18 (an example of a sub-link).

One attachment part 14*a* of the boom 14 is rotatably attached to the front part of the front frame 11. The other attachment part 14*b* of the boom 14 is rotatably attached to the rear part of the bucket 15. The tip of the cylinder rod 16*a* of the boom cylinder 16 is rotatably attached to the attachment part 14*c* provided between the attachment part 14*a* and the attachment part 14*b* of the boom 14. The cylinder body of the boom cylinder 16 is rotatably attached to the front frame 11 at the attachment part 16*b*.

The bell crank 18 includes a bell crank body 18*e* and a rod 18*f*. The attachment part 18*a* provided at one end of the bell crank body 18*e* is rotatably attached to the tip of the cylinder rod 17*a* of the bucket cylinder 17. One end of the rod 18*f* is rotatably attached to an attachment part 18*b* provided at the other end of the bell crank body 18*e*. The other end of the rod 18*f* is rotatably attached to the rear part of the bucket 15 at the attachment part 18*g*. The bell crank body 18*e* rotatably supported by a bell crank support 14*d* near the center of the boom 14 at the attachment part 18*c* (an example of a fourth mounting part) provided between the attachment part 18*a* (an example of a second mounting part) and the attachment part 18*b* (an example of a third mounting part). The cylinder body of the bucket cylinder 17 is rotatably attached to the front frame 11 at the attachment part 17*b* (an example of the first attachment part). The expansion and contraction force of the bucket cylinder 17 is converted into a rotary motion by the bell crank and transmitted to the bucket 15. The sub-link may include a quick coupler or the like in addition to the bell crank 18.

Due to the expansion and contraction of the bucket cylinder 17, the bucket 15 rotates with respect to the boom 14 to perform a tilt operation (see arrow J) and a dump operation (see arrow K). Here, the tilt operation of the bucket 15 is an operation in which the bucket 15 tilts by the opening 15*b* and the claw 15*c* of the bucket 15 rotating toward the cab 5. The dump operation of the bucket 15 is the opposite of the tilt operation, and is an operation in which the bucket 15 tilts by the opening 15*b* and the claw 15*c* of the bucket 15 rotating toward so as to move away from the cab 5.

The boom angle sensor 54 is provided on the attachment part 14*a* of the boom 14. The boom angle sensor 54 detects the boom angle (indicated by θa in the figure) between the center line L1 of the boom 14 and the horizontal line H, and outputs a detection signal. The center line L1 of the boom 14 is a line connecting the attachment part 14*a* and the attachment part 14*b* of the boom 14. The boom angle has a negative value when the center line L1 is inclined toward the road surface R (see FIG. 1) with respect to the horizontal line H.

The bell crank angle sensor 55 is provided on the attachment part 18*c* of the bell crank 18. The bell crank angle sensor 55 detects the bell crank angle (indicated by θb in the figure) between the line L2 connecting the attachment part 18*a* and the attachment part 18*c* of the bell crank 18 and the center line L1 of the boom 14, and outputs the detection signal. The bell crank angle is an example of a posture of the bell crank 18.

Control System

Figure 3:
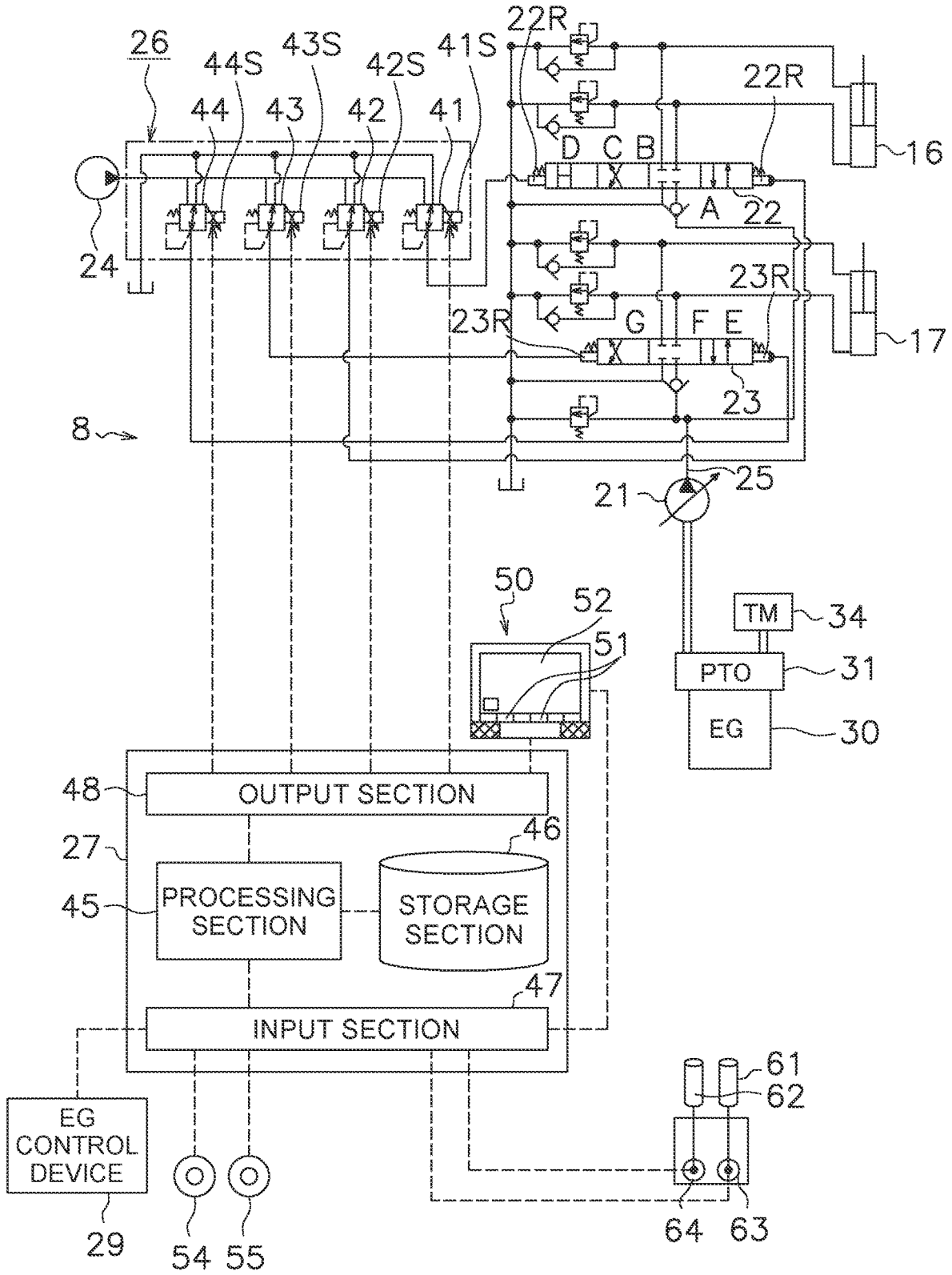
FIG. 3 is a block diagram showing a control system in FIG. 1.

FIG. 3 is a view showing a control system 8 controlling operation of the work implement 3.

The control system 8 controls the operation of work implement 3. The control system 8 includes a work implement hydraulic pump 21, a boom operating valve 22, a bucket operating valve 23, a pilot pump 24, a discharge circuit 25, an electromagnetic proportional control valve 26, a control device 27, and an EG (engine) control device 29.

Work Implement Hydraulic Pump

The work implement hydraulic pump 21 is driven by the engine 30 mounted in the engine room 6. The engine 30 is an internal combustion engine, and for example, a diesel engine is used. The output of the engine 30 is input to the PTO (power Take Off) 31, and then output to the work implement hydraulic pump 21 and the transmission 34. The work implement hydraulic pump 21 is driven by the engine 30 via the PTO 31 to discharge the hydraulic fluid. The input side of the clutch 32 is attached to the engine 30. The output side of the clutch 32 is attached to the torque converter (TC) 33. The output of the engine 30 is transmitted to the transmission 34 via the PTO 31. The transmission 34 transmits the output of the engine 30 transmitted via the PTO 31 to the front tire 4 and the rear tire 7, and the front tire 4 and the rear tire 7 are driven. As the transmission 34, HST (Hydro Static Transmission), electric drive, and the like can be appropriately used.

Discharge Circuit, Boom Operating Valve, Bucket Operating Valve

The discharge circuit 25 is an oil passage through which the hydraulic fluid passes, and is attached to a discharge port in which the work implement hydraulic pump 21 discharges the hydraulic fluid. The discharge circuit 25 is attached to the boom operating valve 22 and the bucket operating valve 23. The boom operating valve 22 and the bucket operating valve 23 are hydraulic pilot type operation valves. The boom operating valve 22 and the bucket operating valve 23 are attached to the vehicle body 2. The work implement hydraulic pump 21, the boom operating valve 22, the bucket operating valve 23, and the discharge circuit 25 form a parallel hydraulic circuit.

The boom operating valve 22 is a 4-position switching valve that can be switched between an A position, a B position, a C position, and a D position. The boom 14 raises when the boom operating valve 22 is in the A position, the boom 14 holds the position neutrally when the boom operating valve 22 is in the B position, the boom 14 lowers when the boom operating valve 22 is in the C position, and D position is "floating".

The bucket operating valve 23 is a three-position switching valve that can be switched between a E position, a F position, and a G position. The bucket 15 tilts (see arrow J in FIG. 2) when the bucket operating valve 23 is in the E position, the bucket 15 holds the position neutrally when the bucket operating valve 23 is in the F position, and the bucket 15 dumps (see arrow K in FIG. 2) when the bucket operating valve 23 is in the G position.

Pilot Pump

The pilot pump 24 is attached to pilot pressure receiving parts of the boom operating valve 22 and pilot pressure receiving parts of the bucket operating valve 23 via the electromagnetic proportional control valve 26. The pilot pump 24 is connected to the PTO 31 and is driven by the engine 30. The pilot pump 24 supplies a hydraulic fluid of pilot pressure to the pilot pressure receiving parts 22R of the boom operating valve 22 and the pilot pressure receiving parts 23R of the bucket operating valve 23 via the electromagnetic proportional control valve 26.

Electromagnetic Proportional Control Valve

The electromagnetic proportional control valve 26 includes a boom lowering electromagnetic proportional control valve 41, a boom raising electromagnetic proportional control valve 42, a bucket dump electromagnetic proportional control valve 43, and a bucket tilt electromagnetic proportional control valve 44.

The boom lowering electromagnetic proportional control valve 41 and the boom raising electromagnetic proportional control valve 42 are attached to each pilot pressure receiving parts 22R of the boom operating valve 22. The bucket dump electromagnetic proportional control valve 43 and the bucket tilt electromagnetic proportional control valve 44 are attached to each pilot pressure receiving parts 23R of the bucket operating valve 23.

A command signal from the control device 27 to each solenoid proportional control valve is input to a solenoid command section 41S of the boom lowering electromagnetic proportional control valve 41, the solenoid command section 42S of the boom raising electromagnetic proportional control valve 42, the solenoid command section 43S of the bucket dump electromagnetic proportional control valve 43, and the solenoid command section 44S of the bucket tilt electromagnetic proportional control valve 44.

The boom 14 is rotated upward or downward by operations of the boom lowering electromagnetic proportional control valve 41, the boom raising electromagnetic proportional control valve 42, the boom operating valve 22, and the boom cylinder 16.

The bucket 15 is tilted and dumped by operation of the bucket dump electromagnetic proportional control valve 43, the bucket tilt electromagnetic proportional control valve 44, the bucket operating valve 23, and the bucket cylinder 17.

Boom Operating Lever, Bucket Operating Lever

The control system 8 is provided with the boom operating lever 61 and the bucket operating lever 62 operated by an operator. The boom operating lever 61 is a lever for operating the boom 14. A first potentiometer 63 for detecting the operation amount of the boom operating lever 61 is attached to the boom operating lever 61.

The bucket operating lever 62 is a lever for operating the bucket 15. A second potentiometer 64 for detecting the operation amount of the bucket operating lever 62 is attached to the bucket operating lever 62.

The detection signals of the first potentiometer 63 and the second potentiometer 64 are input to the input section 47 of the control device 27.

The boom operating lever 61 and the bucket operating lever 62 may be PPC levers that directly drive the operating valve operating the cylinder with pilot pressure.

Control Device

The control device 27 includes, for example, a processing section 45 such as a CPU (Central Processing Unit), a storage section 46 such as a ROM (Read Only Memory), an input section 47, and an output section 48.

The processing section 45 controls operation of the work implement 3 by executing a computer program. The processing section 45 is electrically connected to the storage section 46, the input section 47, and the output section 48. The processing section 45 reads information from the storage section 46 and writes information to the storage section 46. The processing section 45 receives information from the input section 47. The processing section 45 outputs information from the output section 48.

The storage section 46 stores a computer program that controls operation of the work implement 3 and information used for controlling the work implement 3. The storage section 46 stores a computer program to execute a method for controlling the work machine, and the processing section 45 reads and executes this program.

The storage section 46 stores the maximum and minimum values of the cylinder length (an example of the stroke) of the bucket cylinder 17 and the maximum and minimum values of the bell crank angle. The maximum and minimum values of the bell crank angle correspond to an example of limit postures. The maximum and minimum values of the cylinder length correspond to an example of end positions.

In addition, the storage section 46 stores four tables. The first table is a table showing the limit flow rate of the hydraulic fluid to the bucket cylinder 17 set for the difference between the bell crank angle acquired from the bell crank angle sensor 55 and the maximum value of the bell crank angle. The second table is a table showing the limit flow rate of the hydraulic fluid to the bucket cylinder 17 set for the difference between the bell crank angle acquired from the bell crank angle sensor 55 and the minimum value of the bell crank angle. The third table is a table showing the limit flow rate of the hydraulic fluid to the bucket cylinder 17 set for the difference between the maximum value of the cylinder length of the bucket cylinder 17 and the cylinder length of the bucket cylinder 17 acquired from the boom angle sensor 54 and the bell crank angle sensor 55. The fourth table is a table showing the limit flow rate of the hydraulic fluid to the bucket cylinder 17 set for the difference between the minimum value of the cylinder length of the bucket cylinder 17 and the cylinder length of the bucket cylinder 17 acquired from the boom angle sensor 54 and the bell crank angle sensor 55.

Detection signals are input to the input section 47 from the boom angle sensor 54, the bell crank angle sensor 55, the first potentiometer 63, and the second potentiometer 64. The processing section 45 acquires these detection signals and controls the operation of work implement 3.

Further, the cylinder length (indicated by La in FIG. 2) of the bucket cylinder 17 is obtained from the boom angle detected by the boom angle sensor 54 and the bell crank angle detected by the bell crank angle sensor 55.

The control device 27 obtains the cylinder length of the boom cylinder 16 and the cylinder length of the bucket cylinder 17 by using the detected values of at least one of the boom angle sensor 54 and the bell crank angle sensor 55, and controls the operations of the boom 14 and the bucket 15.

The output section 48 outputs drive commands to the solenoid command section 41S of the boom lowering electromagnetic proportional control valve 41, the solenoid command section 42S of the boom raising electromagnetic proportional control valve 42, the solenoid command section 43S of the bucket dump electromagnetic proportional control valve 43, and the solenoid command section 44S of the bucket tilt electromagnetic proportional control valve 44, and the input/output device 50.

The processing section 45 gives a command value for operating the boom cylinder 16 to the solenoid command section 41S of the boom lowering electromagnetic proportional control valve 41 or the solenoid command section 42S of the boom raising electromagnetic proportional control valve 42, expands and contracts the boom cylinder 16, and raises and lowers the boom 14.

The processing section 45 gives a command value for operating the bucket cylinder 17 to the solenoid command section 43S of the bucket dump electromagnetic proportional control valve 43 or the solenoid command section 44S of the bucket tilt electromagnetic proportional control valve 44, expands and contracts the bucket cylinder 17, and tilts or dumps the bucket 15.

The input/output device 50 is provided inside the cab 5. The input/output device 50 is connected to both the input section 47 and the output section 48. The input/output device 50 includes an input device 51 and a display device 52. The operator can input a command value from the input device 51 to the control device 27. The display device 52 displays information on the status or the control of work implement 3. The input device 51 can use a touch panel or a push button type switch. As will be described later, by operating the input device 51, it is possible to display a calibration mode for calibrating the maximum value of the bell crank angle at the tilt end.

Mitigation Stop Control

In the wheel loader 1 of the present embodiment, mitigation stop control is performed at the tilt end and the dump end in order to mitigate the impact at the tilt end and the dump end.

The control device 27 of the present embodiment performs mitigation stop control based on the bell crank angle and the stroke length of the bucket cylinder 17.

Before explaining the configuration of the processing section 45 for performing mitigation stop control, it will be described that reaching the tilt end and the dump end area detected with the bell crank angle and the stroke length of the bucket cylinder 17.

Figure 4:
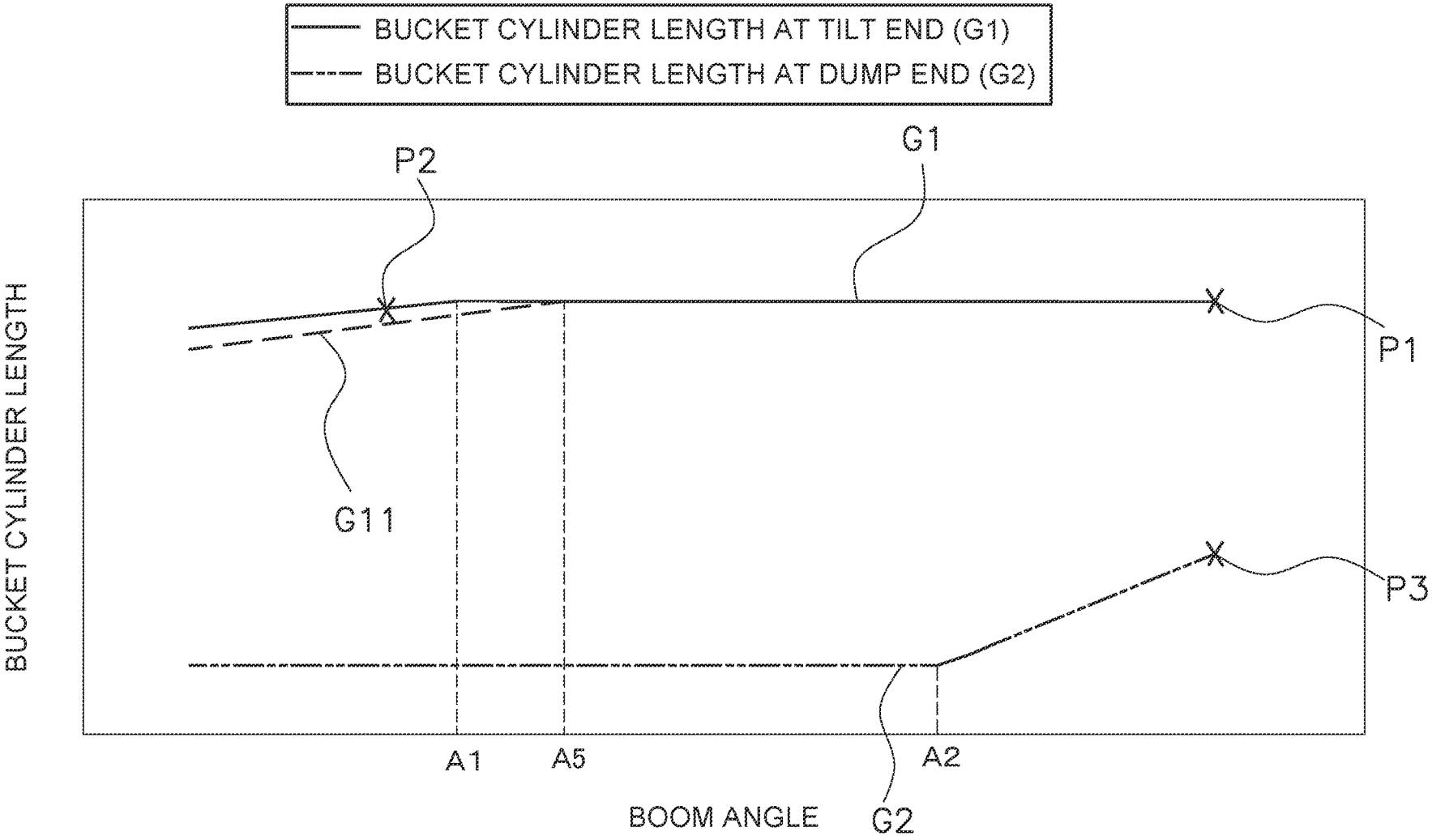
FIG. 4 is a view showing a change in a bucket cylinder length at a tilt end with respect to a boom angle and a change in a bucket cylinder length at a dump end with respect to a boom angle.

FIG. 4 is a view showing a change (G1) in the bucket cylinder length at the tilt end with respect to the boom angle and a change (G2) in the bucket cylinder length at the dump end with respect to the boom angle. The vertical axis shows the bucket cylinder length, and the horizontal axis shows the boom angle.

As shown in G1, when the boom angle is from the maximum value to A1 degree, the bucket reaches the tilt end at the maximum value of the cylinder length of the bucket cylinder 17.

Figure 5:
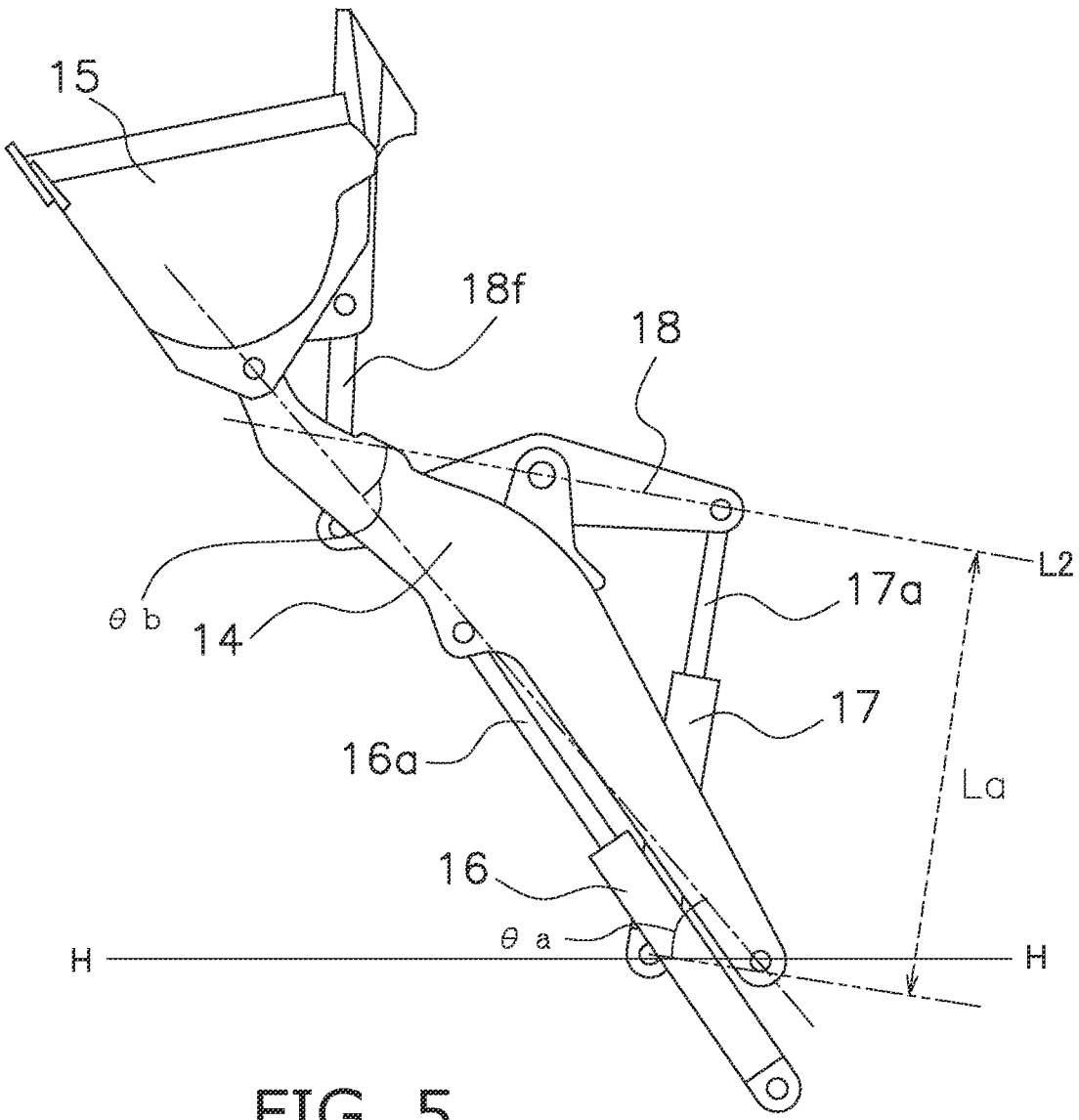
FIG. 5 is a view showing an example of a state of work implement at P1 in FIG. 4.

FIG. 5 is a view showing a state in which the bucket reaches the tilt end at the maximum value of the bucket cylinder 17, and is a view showing an example of a work implement state in P1 of FIG. 4. FIG. 5 shows a state in which the boom angle is the maximum value, the bucket cylinder 17 is fully extended, and the bucket 15 reaches the tilt end.

On the other hand, when the boom angle is from A1 degree to the minimum value, the bucket reaches the tilt end before the cylinder length of the bucket cylinder 17 reaches the maximum value.

Figure 6:
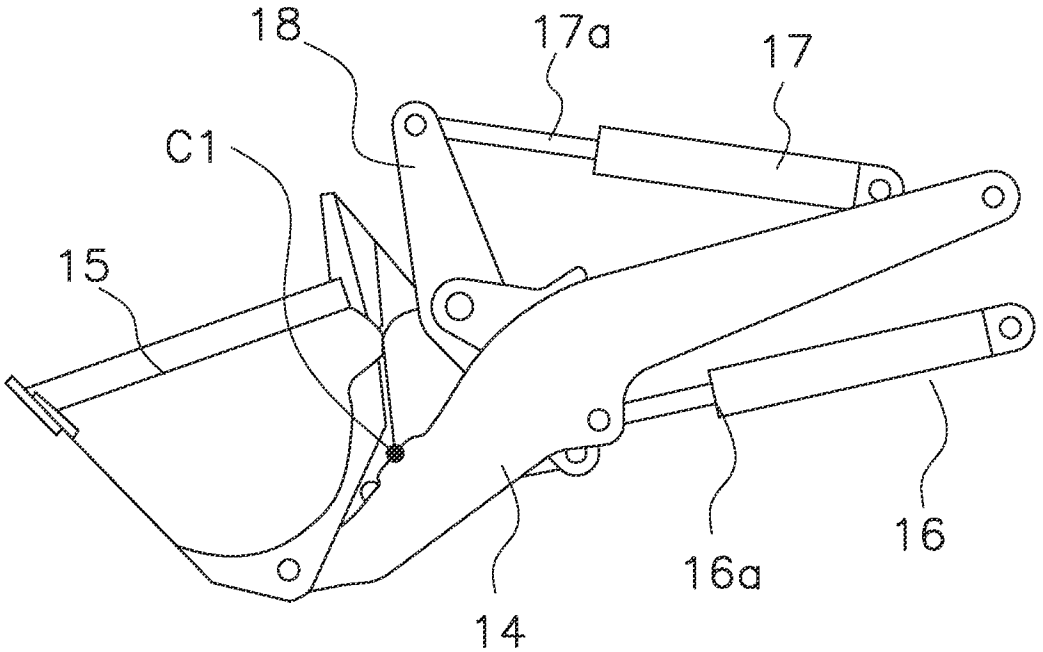
FIG. 6 is a view showing an example of a state of work implement at P2 in FIG. 4.

This is because the link mechanism of work implement 3 reaches the mechanism limit before the cylinder length of the bucket cylinder 17 reaches the maximum value, and the bucket cylinder 17 cannot be extended any more. FIG. 6 is a view showing an example of work implement 3 in P2 of FIG. 4. In the state shown in FIG. 6, since the bucket 15 is in contact with the bell crank 18, the bucket cylinder 17 cannot be extended any more. In FIG. 6, the contact position is illustrated as C1, but the contact position at the mechanical limit changes depending on the configuration of the link of work implement 3.

In this way, the bucket 15 reaches the tilt end due to the mechanical limit of the link mechanism of work implement 3 from the minimum value to the angle A1, and the bucket 15 reaches the tilt end at the maximum value of the cylinder length of the bucket cylinder 17 from the angle A1 to the maximum value.

On the other hand, as shown in G2, the bucket reaches the dump end at the minimum value of the bucket cylinder 17 when the boom angle is from the minimum value to A2 degrees, but the bucket reaches the dump end before the cylinder length of the bucket cylinder 17 reaches the minimum value when the boom angle is from A2 degrees to the maximum value.

Figure 7:
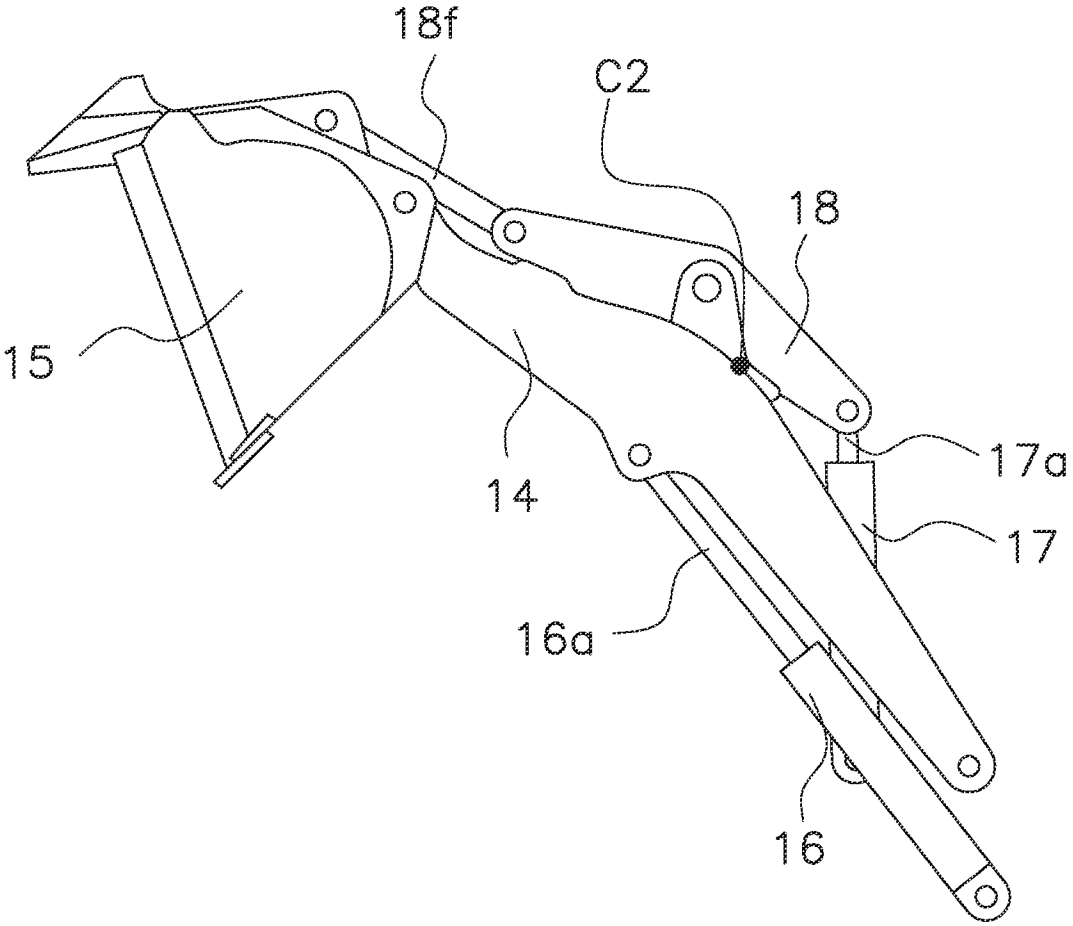
FIG. 7 is a view showing an example of a state of work implement at P3 in FIG. 4.

This is because the link mechanism of work implement 3 reaches the mechanism limit before the cylinder length of the bucket cylinder 17 reaches the minimum value, and the bucket cylinder 17 cannot be contracted any more. FIG. 7 is a view showing an example of work implement 3 in P3 of FIG. 4. In the state shown in FIG. 7, since the bell crank 18 is in contact with the frame part of the boom 14 arranged along the left-right direction, the bucket cylinder 17 cannot be contracted any more (see point C2).

In this way, the bucket cylinder 17 reaches the tilt end at the minimum value of the cylinder length of the bucket cylinder 17 when the boom angle is from the minimum value to A2 degrees, and the bucket 15 reaches the dump end due to the mechanical limits of the link mechanism of the work implement 3 when the boom angle is from the predetermined value to the maximum value.

As described above, in the region where the bucket reaches the tilt end and the dump end due to the mechanical limit, the stroke length of the bucket cylinder 17 depends on the boom angle, but since the link mechanism reaches the mechanical limit, the bell crank angle is constant.

Figure 8:
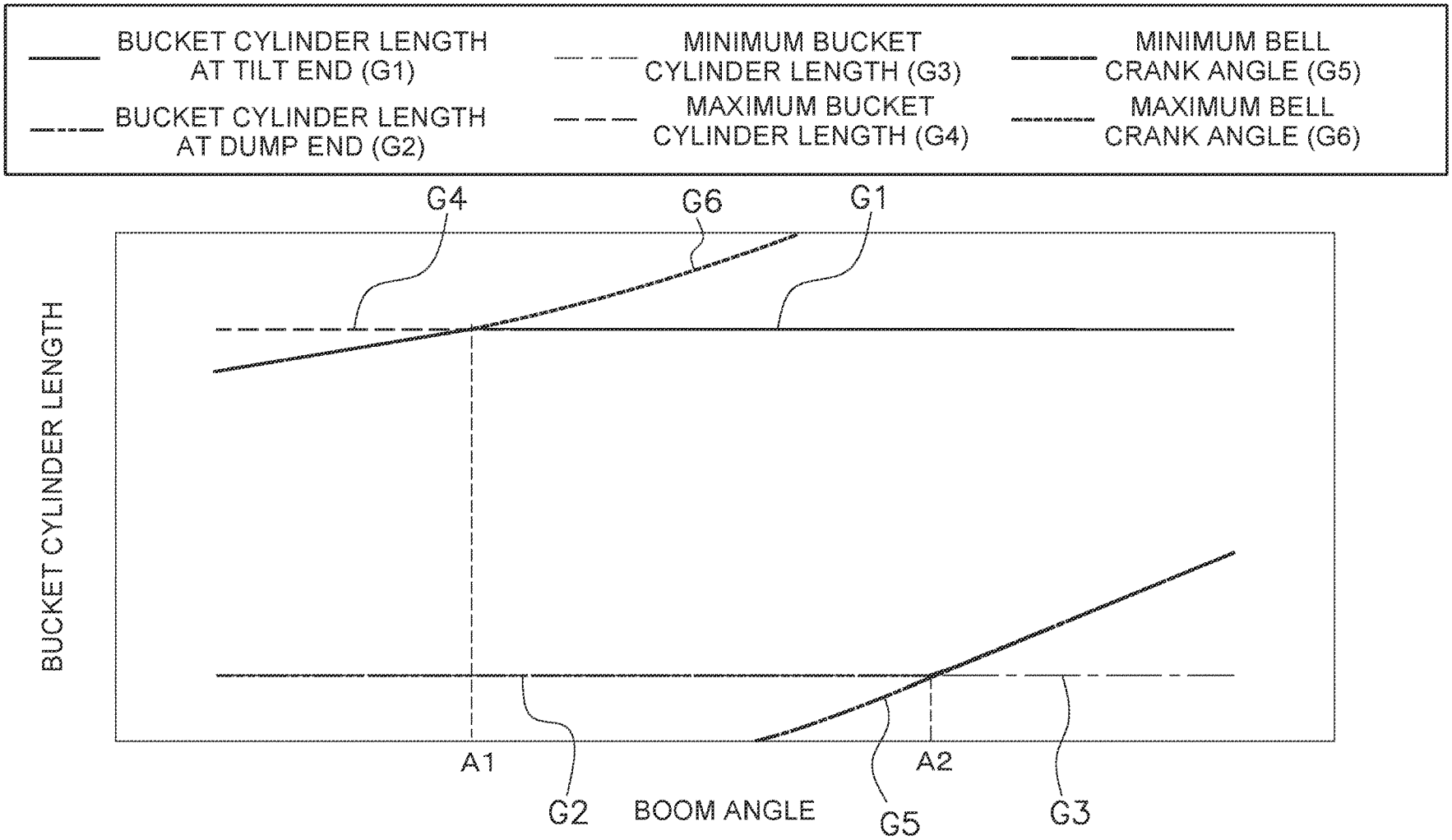
FIG. 8 is a view in which change in a minimum value of a bucket cylinder length, change in a maximum value of a bucket cylinder length, change in a minimum value of a bell crank angle, and change in a maximum value of the bell crank angle with respect to the boom angle are added to the graph of FIG. 5.

FIG. 8 is a view in which the minimum value of the bucket cylinder length (G3), the maximum value of the bucket cylinder length (G4), the minimum value of the bell crank angle (G5), and the maximum value of the bell crank angle (G6) are added to the graph of FIG. 5. The vertical axis shows the bucket cylinder length and the horizontal axis shows the boom angle.

As shown in G1 of the bucket cylinder length at the tilt end and G4 of the maximum value of the bucket cylinder length, the maximum value G6 of the bell crank angle matches G1 in the region where the stroke length of the bucket cylinder 17 does not reach the maximum value.

On the other hand, as shown in G2 of the bucket cylinder length at the dump end and G3 of the minimum value of the bucket cylinder length, the minimum value G5 of the bell crank angle matches G2 in the region where the bucket cylinder length does not reach the minimum value.

Figure 9:
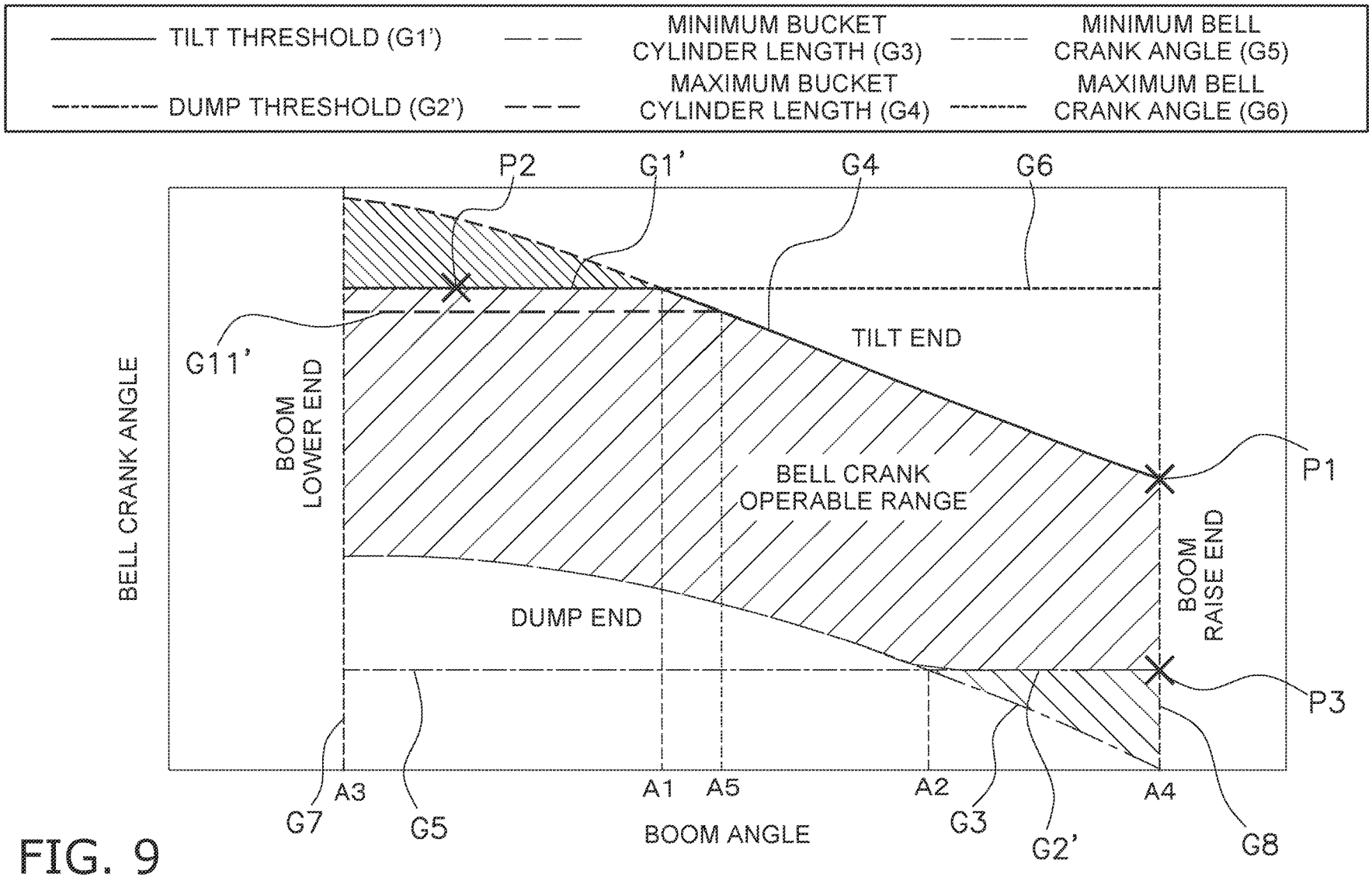
FIG. 9 is a view showing a graph in which the vertical axis of the graph of FIG. 8 is converted into a bell crank angle.

FIG. 9 is a view showing a graph in which the vertical axis of the graph of FIG. 8 is converted into a bell crank angle. As shown in FIG. 9, the graph corresponding to G1 in FIG. 8 is illustrated as G1', and G1' shows the change in the bell crank angle at the tilt end with respect to the boom angle. Further, the graph corresponding to G2 in FIG. 8 is illustrated as G2', and G2' shows the change in the bell crank angle at the dump end with respect to the boom angle.

Further, the end line G7 when the boom is lowered is drawn at A3 degree, and the end line G8 when the boom is raised is drawn at A4 degree.

As shown in FIG. 9, in the region where the stroke length of the bucket cylinder 17 does not reach the maximum value at the tilt end, the bucket 15 reaches the tilt end at the maximum value G6 of the bell crank angle. Further, in the region where the stroke length of the bucket cylinder does not reach the minimum value at the dump end, the bucket 15 reaches the dump end at the minimum value G5 of the bell crank angle.

As illustrated in FIGS. 8 and 9, it is possible to detect that the bucket 15 reaches the tilt end by combining the maximum value of the bucket cylinder length and the maximum value of the bell crank angle.

Note that G11 illustrated by a dotted line in FIG. 4 is a graph showing the bucket cylinder length at the tilt end when the bucket 15 is replaced with another one. The graph corresponding to G11 in FIG. 4 is illustrated as G11' in FIG. 9. In G11 and G11', unlike G1 and G1', the bucket reaches the tilt end at the maximum value of the cylinder length of the bucket cylinder 17 when the boom angle is from the maximum value to A5 degrees, and the bucket reaches the tilt end before the cylinder length of the bucket cylinder 17 reaches the maximum value when the boom angle is from A5 degrees to the minimum value.

The bucket 15 may be replaced with one having a different size by the operator. In that case, the mechanical limit also changes and the maximum value of the bell crank angle also changes, but as described above, the bell crank angle at the mechanical limit is constant. Therefore, when the bucket is replaced, it is possible to detect that the bucket 15 reaches the tilt end by obtaining the maximum value of the bell crank angle at the mechanical limit with calibration and using the maximum value and the bucket cylinder length. The calibration of the maximum value of the bell crank angle when the bucket is replaced will be described later.

Further, by combining the minimum value of the bucket cylinder length and the minimum value of the bell crank angle, it is possible to detect that the bucket 15 reaches the dump end.

In the present embodiment, the dump end is determined by the shapes of the boom 14 and the bell crank 18 regardless of the bucket 15, so that it is not necessary to perform calibration and the dump end is determined by the design value.

Processing Section

Figure 10:
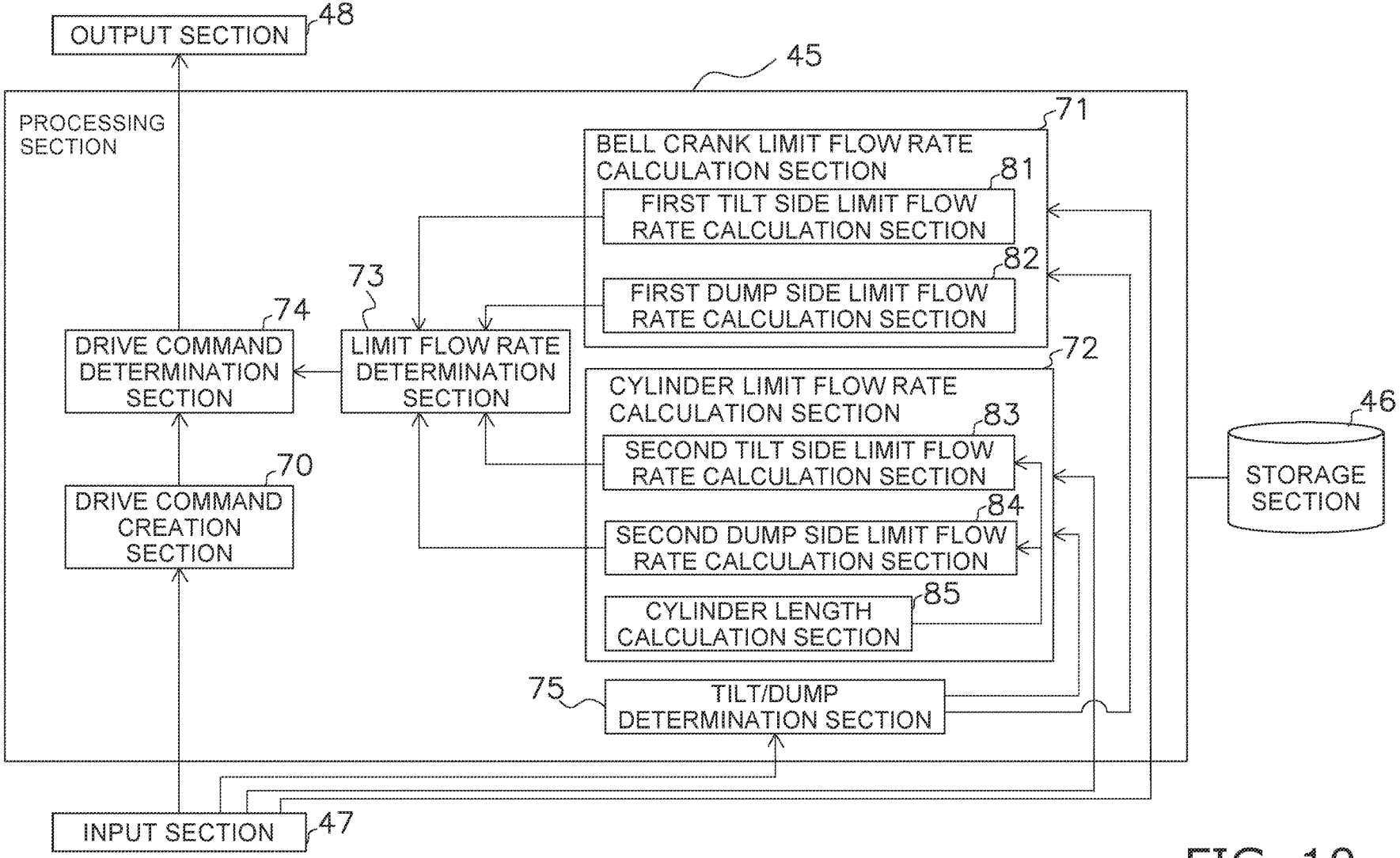
FIG. 10 is a block diagram showing a configuration of a processing section of FIG. 3.

FIG. 10 is a block diagram showing the configuration of the processing section 45 of the present embodiment. The processing section 45 includes a drive command creation section 70, a bell crank limit flow rate calculation section 71, a cylinder limit flow rate calculation section 72, a limit flow rate determination section 73, a drive command determination section 74, and a tilt/dump determination section 75.

The drive command creation section 70 creates a drive command based on the operation of the boom operating lever 61 and the bucket operating lever 62 by the operator. When the boom operating lever 61 and the bucket operating lever 62 are operated by the operator, the drive command creation section 70 acquires the operation amount signal of the boom operating lever 61 and the bucket operating lever 62 from the first potentiometer 63 and the second potentiometer 64 via the input section 47. Then, the drive command creation section 70 creates a drive command (an example of a target cylinder drive command) corresponding to the operation amount signal.

This drive command is a command to drive the boom cylinder 16 or the bucket cylinder 17 so as to correspond to the operation amount signal, and defines the flow rate of the hydraulic fluid supplied to the boom cylinder 16 or the bucket cylinder 17. Specifically, the drive command is a command so that the boom lowering electromagnetic proportional control valve 41, the boom raising electromagnetic proportional control valve 42, the bucket dump electromagnetic proportional control valve 43, or the bucket tilt electromagnetic proportional control valve 44 is set to the opening degree such that the hydraulic fluid of the flow rate corresponding to the operation amount flows.

When a drive command is output to the boom lowering electromagnetic proportional control valve 41, the boom raising electromagnetic proportional control valve 42, the bucket dump electromagnetic proportional control valve 43, or the bucket tilt electromagnetic proportional control valve 44, the boom lowering electromagnetic proportional control valve 41, the boom raising electromagnetic proportional control valve 42, the bucket dump electromagnetic proportional control valve 43, or the bucket tilt electromagnetic proportional control valve 44 is driven according to the opening degree information of the drive command. As a result, the pilot pressure according to the drive command is output from the boom lowering electromagnetic proportional control valve 41, the boom raising electromagnetic proportional control valve 42, the bucket dump electromagnetic proportional control valve 43, or the bucket tilt electromagnetic proportional control valve 44 to the pilot pressure receiving part of the boom operating valve 22 or the bucket operating valve 23. Then the boom cylinder 16 or the bucket cylinder 17 operates in the corresponding directions at a speed corresponding to each pilot oil pressure.

The tilt/dump determination section 75 determines whether the bucket 15 is operated to the tilt side or the dump side based on the detection signal from the second potentiometer 64 that detects the operation amount of the bucket operating lever 62. The tilt/dump determination section 75 transmits the determination result to the bell crank limit flow rate calculation section 71 and the cylinder limit flow rate calculation section 72.

The bell crank limit flow rate calculation section 71 calculates the limit flow rate when driving the bucket cylinder 17 based on the bell crank angle acquired from the bell crank angle sensor 55 via the input section 47.

The bell crank limit flow rate calculation section 71 includes a first tilt side limit flow rate calculation section 81 and a first dump side limit flow rate calculation section 82.

When it is determined that the bucket 15 is operated toward the tilt side, the first tilt side limit flow rate calculation section 81 calculates the difference between the maximum value of the bell crank angle stored in the storage section 46 and the bell crank angle acquired by the bell crank angle sensor 55, and acquires the first tilt side limit flow rate (an example of the first cylinder drive command) from the first table stored in the storage section 46. In the first table, the smaller the difference (the closer the bell crank angle is to the maximum value), the larger the limit flow rate of the flow rate of hydraulic fluid supplied to the bucket cylinder 17 is set. By increasing the limit flow rate, the moving speed of the cylinder rod 17*a* of the bucket cylinder 17 is limited. That is, by limiting the moving speed of the bell crank 18 before reaching the maximum value of the bell crank angle, it is possible to stop gently when reaching the tilt end due to the mechanism limit.

When it is determined that the bucket 15 is operated toward the dump side, the first dump side limit flow rate calculation section 82 calculates the difference between the minimum value of the bell crank angle stored in the storage section 46 and the bell crank angle acquired by the bell crank angle sensor 55, and acquires the first dump side limit flow rate (an example of the first cylinder drive command) from the second table stored in the storage section 46. In the second table, the smaller the difference (the closer the bell crank angle is to the minimum value), the larger the limit flow rate of the flow rate of the hydraulic fluid supplied to the bucket cylinder 17 is set.

The cylinder limit flow rate calculation section 72 includes a cylinder length calculation section 85, a second tilt side limit flow rate calculation section 83, and a second dump side limit flow rate calculation section 84.

The cylinder length calculation section 85 calculates the cylinder length of the bucket cylinder 17 based on the boom angle acquired from the boom angle sensor 54 and the bell crank angle acquired from the bell crank angle sensor 55.

When it is determined that the bucket 15 is operated to the tilt side, the second tilt side limit flow rate calculation section 83 calculates the difference between the maximum value of the bucket cylinder length stored in the storage section 46 and the cylinder lengths calculated by the cylinder length calculation section 85, and acquires the second tilt side limit flow rate (an example of a second cylinder drive command) from the third table stored in the storage section 46. In the third table, the smaller the difference (the closer the cylinder length is to the maximum value), the larger the limit flow rate of the flow rate of the hydraulic fluid supplied to the bucket cylinder 17 is set.

When it is determined that the bucket 15 is operated to the dump side, the second dump side limit flow rate calculation section 84 calculates the difference between the minimum value of the bucket cylinder length stored in the storage section 46 and the cylinder lengths calculated by the cylinder length calculation section 85, and acquires the second dump side limit flow rate (an example of the second cylinder drive command) from the fourth table stored in the storage section 46. In the fourth table, the smaller the difference (the closer the cylinder length is to the minimum value), the larger the limit flow rate of the flow rate of the hydraulic fluid supplied to the bucket cylinder 17 is set.

When it is determined that the bucket 15 is operated to the tilt side, the limit flow rate determination section 73 determines the larger flow rate of the first tilt side limit flow rate and the second tilt side limit flow rate as the limit flow rate for the drive command of the bucket cylinder 17. Further, when it is determined that the bucket 15 is operated to the dump side, the limit flow rate determination section 73 determines the larger flow rate of the first dump side limit flow rate and the second dump side limit flow rate as the limit flow rate for the drive command of the bucket cylinder 17.

As described above, in the case of the operation of the bucket 15 to the tilt side, the limit flow rate for the closer one of the maximum value of the bell crank angle and the maximum value of the bucket cylinder length is adopted. Further, in the case of the operation of the bucket 15 to the dump side, the limit flow rate for the closer one of the minimum value of the bell crank angle and the minimum value of the bucket cylinder length is adopted.

The larger limit flow rate means that the limited flow rate is large. For example, when the maximum flow rate is 100% and the limit flow rate is 40%, the hydraulic fluid is supplied to the bucket cylinder 17 at a flow rate of 60%. That is, the larger the limit flow rate, the smaller the flow rate of the hydraulic fluid supplied to the bucket cylinder 17.

As a result, in the case of operation of the bucket 15 to the tilt side, the limit flow rate increases as the bell crank angle approaches the maximum value or the bucket cylinder length approaches the maximum value, so that the moving speed of the bucket 15 slows down and it is possible to mitigate the impact at the tilt end. Further, in the case of the operation of the bucket 15 to the dump side, the limit flow rate increases as the bell crank angle approaches the minimum value or the bucket cylinder length approaches the minimum value, so that the moving speed of the bucket 15 slows down and it is possible to mitigate the impact at the dump end.

When the flow rate of the hydraulic fluid supplied to the bucket cylinder 17 by the drive command created by the drive command creation section 70 exceeds the limit flow rate, the drive command determination section 74 creates a drive command of the maximum flow rate so as to keep the limit flow rate. That is, the limit flow rate is 40%, the flow rate can be supplied up to 60%, but when the flow rate of the hydraulic fluid supplied to the bucket cylinder 17 of the drive command created by the drive command creation section 70 is set to 80%, the drive command determination section 74 determines the drive command so that the flow rate is 60%. That is, the limit flow rate is the upper limit value of the flow rate that can be commanded to drive. When the flow rate of the hydraulic fluid supplied to the bucket cylinder 17 with the drive command created by the drive command creation section 70 does not exceed the limit flow rate, the drive command determination section 74 control the bucket cylinder 17 with the created drive command (an example of a cylinder drive command).

The opening degree of the bucket tilt electromagnetic proportional control valve 44 is narrowed in order to increase the limit flow rate of the hydraulic fluid when it is determined that the bucket 15 is operated to the tilt side. As a result, the pilot pressure can be lowered, so that the flow rate of the hydraulic fluid to the bucket cylinder 17 can be limited.

Further, the opening degree of the bucket dump electromagnetic proportional control valve 43 is narrowed in order to increase the limit flow rate of the flow rate of the hydraulic fluid when it is determined that the bucket 15 is operated to the dump side. As a result, the pilot pressure can be lowered, so that the flow rate of the hydraulic fluid to the bucket cylinder 17 can be limited.

Operation

Next, the operation of the embodiment according to the present invention will be described.

Method for Controlling

Figure 11:
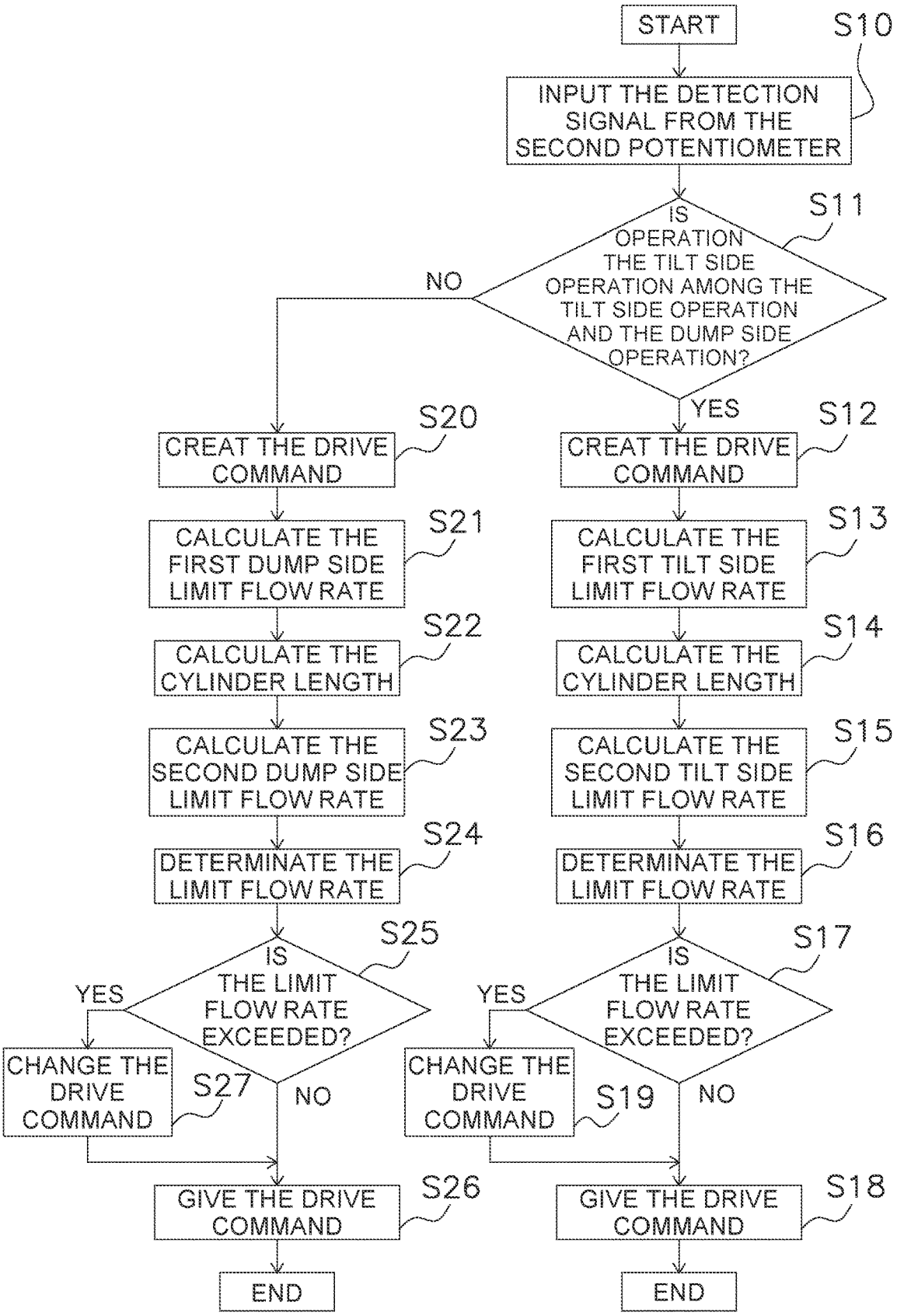
FIG. 11 is a flow chart showing a method for controlling the work machine according to the embodiment of the present invention.

FIG. 11 is a flow chart showing a method for controlling the work machine of the present embodiment.

First, in step S10, when the bucket operating lever 62 is operated by the operator, the second potentiometer 64 detects the operating amount of the bucket operating lever 62, and the detection signal is input to the input section 47 of the control device 27.

Next, in step S11, the tilt/dump determination section 75 determines whether the bucket 15 is operated to the tilt side or the dump side based on the detection signal of the second potentiometer 64.

In the step S11, when it is determined that the operation is on the tilt side, the control proceeds to step S12.

Next, in step S12, the drive command creation section 70 creates a drive command for transmitting to the solenoid command section 44S of the bucket tilt electromagnetic proportional control valve 44 so that the flow rate of the hydraulic fluid based on the detection signal by the second potentiometer 64 is supplied to the bucket cylinder 17.

Next, in step S13, the first tilt side limit flow rate calculation section 81 calculates the difference between the maximum value of the bell crank angle stored in the storage section 46 and the bell crank angle acquired from the bell crank angle sensor 55, and calculates the first tilt side limit flow rate from the first table stored in the storage section 46.

Next, in step S14, the cylinder length calculation section 85 calculates the cylinder length of the bucket cylinder 17 based on the boom angle acquired from the boom angle sensor 54 and the bell crank angle acquired from the bell crank angle sensor 55.

Next, in step S15, the second tilt side limit flow rate calculation section 83 calculates the difference between the maximum value of the bucket cylinder length stored in the storage section 46 and the cylinder length calculated by the cylinder length calculation section 85, and acquires the second tilt side limit flow rate from the third table.

Next, in step S16, the limit flow rate determination section 73 determines the larger limit flow rate of the calculated first tilt side limit flow rate and the calculated second tilt side limit flow rate as the limit flow rate for the drive command to the bucket cylinder 17.

Next, in step S17, the drive command determination section 74 determines whether or not the flow rate of the hydraulic fluid supplied to the bucket cylinder 17 by the drive command created by the drive command creation section 70 exceeds the limit flow rate.

When it is determined in step S17 that the flow rate of the supplied hydraulic fluid does not exceed the limit flow rate, the control proceeds to step S18, and in step S18, the drive command created in step S12 is output from the output section 48 to the solenoid command section 44S of the bucket tilt electromagnetic proportional control valve 44.

On the other hand, when it is determined in step S17 that the flow rate of the supplied hydraulic fluid exceeds the limit flow rate, the control proceeds to step S19, and in step S19, the drive command determination section 74 change the drive command so as to maximize the flow rate without exceeding the limit flow rate. Subsequently, in step S18, the changed drive command is output from the output section 48 to the solenoid command section 44S of the bucket tilt electromagnetic proportional control valve 44.

On the other hand, in step S11, when the tilt/dump determination section 75 determines that the operation is on the dump side based on the detection signal of the second potentiometer 64, the control proceeds to step S20.

In step S20, the drive command creation section 70 creates a drive command for transmitting to the solenoid command section 43S of the bucket dump electromagnetic proportional control valve 43 so that the flow rate of the hydraulic fluid based on the detection signal by the second potentiometer 64 is supplied to the boom cylinder 16 and the bucket cylinder 17.

In step S21, the first dump side limit flow rate calculation section 82 calculates the difference between the minimum value of the bell crank angle stored in the storage section 46 and the bell crank angle acquired from the bell crank angle sensor 55, and acquires the first dump side limit flow rate from the second table stored in the storage section 46.

Next, in step S22, the cylinder length calculation section 85 calculates the cylinder length of the bucket cylinder 17 based on the boom angle acquired from the boom angle sensor 54 and the bell crank angle acquired from the bell crank angle sensor 55.

Next, in step S23, the second dump side limit flow rate calculation section 84 calculates the difference between the minimum value of the bucket cylinder length stored in the storage section 46 and the cylinder length calculated by the cylinder length calculation section 85, and acquires the second dump side limit flow rate from the fourth table stored in the storage section 46.

Next, in step S24, the limit flow rate determination section 73 determines the larger limit flow rate of the calculated first dump side limit flow rate and the calculated second dump side limit flow rate as the limit flow rate for the drive command to the bucket cylinder 17.

Next, in step S25, the drive command determination section 74 determines whether or not the flow rate of the hydraulic fluid supplied to the bucket cylinder 17 by the drive command created by the drive command creation section 70 exceeds the limit flow rate.

When it is determined in step S25 that the flow rate of the supplied hydraulic fluid does not exceed the limit flow rate, the control proceeds to step S26, and in step S26, the drive command created in step S20 is output from the output section 48 to the solenoid command section 43S of the bucket dump electromagnetic proportional control valve 43.

On the other hand, when it is determined in step S25 that the flow rate of the supplied hydraulic fluid exceeds the limit flow rate, the control proceeds to step S27, and in step S27, the drive command determination section 74 change the drive command so as to maximize the flow rate without exceeding the limit flow rate. Subsequently, in step S26, the changed drive command is output from the output section 48 to the solenoid command section 43S of the bucket dump electromagnetic proportional control valve 43.

Method for Calibrating

Figure 12:
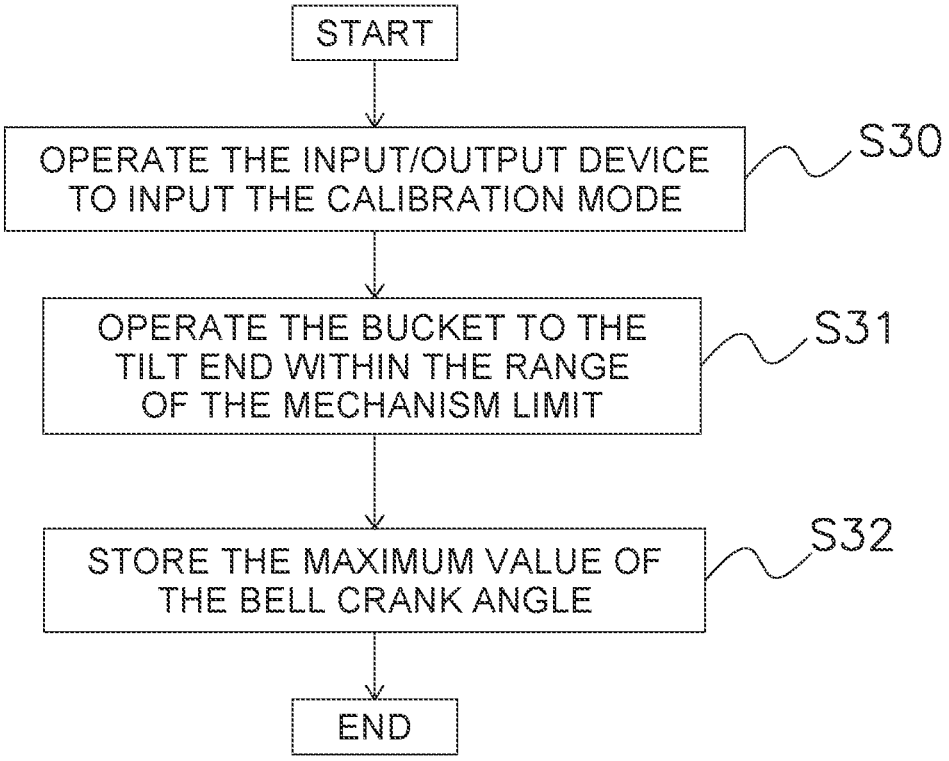
FIG. 12 is a flow chart showing a method for calibrating the maximum value of the bell crank angle.

Next, a method for calibrating the maximum value of the bell crank angle when the bucket 15 is replaced will be described. FIG. 12 is a flow chart showing a method for calibrating the maximum value of the bell crank angle.

When the bucket 15 is replaced, in step S30, the operator operates the input device 51 of the input/output device 50 to switch to the calibration mode screen of the maximum value of the bell crank angle.

In step S31, according to the instruction displayed on the display device 52 of the input/output device 50, the operator operates the bucket 15 to the tilt end (the position where the bucket 15 abuts on the boom 14) within the range of the mechanism limit where the bucket cylinder length does not reach the maximum value. For example, in the case of the graph of G11 in FIG. 4, the boom angle may be set to a value lower than A5 degrees and the bucket 15 may be operated to the tilt end. Actually, since the boom angle that reaches the mechanism limit is not known, the bucket 15 may be tilted with the boom angle lowered as much as possible.

Next, in step S32, the bell crank angle at the tilt end is stored as the maximum value of the bell crank angle.

The maximum value of the stored bell crank angle is used in the method for controlling described above.

Features (1)

The wheel loader 1 (an example of a work machine) of the present embodiment includes a boom 14, a bucket 15 (an example of a work tool), a bucket cylinder 17 (an example of an actuator), and a bell crank 18 (an example of a sub-link), and a control device 27 (an example of a control section). The bucket 15 drives with respect to the boom 14. The bell crank 18 is attached to the boom 14 and transmits the driving force of the bucket cylinder 17 to the bucket 15. The control device 27 controls the bucket cylinder 17 based on the angle (an example of posture) of the bell crank 18 with respect to the boom 14.

As a result, since the tilt end and the dump end when the link mechanism of work implement 3 reaches the mechanism limit can be detected based on the angle of the bell crank 18, it is possible to perform control of mitigating an impact when the mechanism limit is reached.

(2)

In the wheel loader 1 (an example of a work machine) of the present embodiment, one end of the bucket cylinder 17 is rotatably attached to the vehicle body 2 (an example of a vehicle body) at the attachment part 17*b* (an example of a first mounting part). The bell crank 18 is rotatably attached to the other end of the bucket cylinder 17 at an attachment part 18*a* (an example of a second attachment part). The bell crank 18 is rotatably attached to the bucket 15 at the attachment part 18*b* (an example of the third attachment part). The bell crank 18 is rotatably attached to the boom 14 at the attachment part 18*c* (an example of the fourth attachment part) between the attachment part 18*a* and the attachment part 18*b*.

As a result, the bucket 15 can rotate to the tilt side and the dump side by the expansion and contraction of the bucket cylinder 17.

(3)

In the wheel loader 1 (an example of a work machine) of the present embodiment, the bucket 15 is rotatably attached to the boom 14 at the attachment part 14*b* (an example of the fifth attachment part), and the boom 14 is rotatably attached to the vehicle body 2 at the attachment part 14*a* (an example of the sixth attachment part). The posture of the bell crank 18 includes an angle formed by a line connecting the attachment part 18*a* and the attachment part 18*c* and a line connecting the attachment part 14*a* and the attachment part 14*b*.

The posture of the bell crank 18 can be defined by this angle.

(4)

The wheel loader 1 (an example of a work machine) of the present embodiment includes a boom angle sensor 54 and a bell crank angle sensor 55 (an example of a detection section) for detecting the stroke of the bucket cylinder 17. The control device 27 gives the drive command (an example of a target cylinder drive command) based on either the first tilt limit flow rate (an example of a first cylinder drive command) and the first dump limit flow rate (an example of a first cylinder drive command) based on differences between the bell crank angle (an example of the posture) of the bell crank 18, and the maximum value (an example of the limit posture) and the minimum value (an example of the limit posture) of the bell crank angle of the bell crank 18, and the second tilt limit flow rate (an example of a second cylinder drive command) and the second dump limit flow rate (an example of a second cylinder drive command) based on differences between the cylinder length, and the maximum value (an example of the end position) and the minimum value (an example of the end position) of the cylinder length of the bucket cylinder 17.

In this way, by setting the limit flow rate based on the maximum value and the minimum value of the bell crank angle, it is possible to perform mitigation control when the bucket 15 reaches the tilt end and the dump end due to the mechanism limit of the link mechanism of the work implement 3.

Further, by setting the limit flow rate based on the maximum value and the minimum value of the cylinder length of the bucket cylinder 17, it is possible to perform mitigation control when the bucket 15 reaches the tilt end and the dump end due to the cylinder length of the work implement 3.

(5)

The wheel loader 1 (an example of a work machine) of the present embodiment further includes a bucket operating lever 62 (an example of an operating member) for operating the bucket 15. The drive command (an example of a target cylinder drive command) includes information on the supplied flow rate of the hydraulic fluid to the bucket cylinder 17. Each of the first tilt limit flow rate, the first dump limit flow rate, the second tilt limit flow rate, and the second dump limit flow rate includes information on the limit flow rate for the supplied flow rate of hydraulic fluid to the bucket cylinder 17 by operation of the bucket operating lever 62. The control device 27 gives a target cylinder drive command using the largest limit flow rate of the first tilt limit flow rate, the first dump limit flow rate, the second tilt limit flow rate, and the second dump limit flow rate.

As a result, it is possible to perform mitigation control for the bucket 15 to reach either the tilt end or the dump end due to the mechanical limit of the link mechanism of work implement 3 or the tilt end or the dump end due to the cylinder length of work implement 3.

(6)

In the wheel loader 1 (an example of an work machine) of the present embodiment, the control device 27 sets the supplied flow rate of the hydraulic fluid in the target cylinder drive command to a flow rate that does not exceed the limit flow rate when the supplied flow rate of hydraulic fluid based on the operation of the bucket operating lever 62 exceeds the limit flow rate. The control device 27 sets the supplied flow rate of the hydraulic fluid in the target cylinder drive command to a flow rate of hydraulic fluid based on the operation of the bucket operating lever 62 when the supply flow rate of hydraulic fluid based on the operation of the bucket operating lever 62 does not exceed the limit flow rate.

Thereby, it is possible to perform control so as to mitigate the impact when the bucket reaches the tilt end and the dump end.

(7)

The method for controlling the wheel loader 1 (an example of a work machine) of the present embodiment includes steps S11 to S20 (an example of a control step). In steps S11 to S20 (an example of a control step), the bucket cylinder is controlled based on the posture of the bell crank 18 with respect to the boom 14. The bell crank 18 transmits the driving force of the bucket cylinder 17 to the bucket 15 driving with respect to the boom 14, As a result, since the tilt end and the dump end when the link mechanism of work implement 3 reaches the mechanism limit can be detected based on the angle of the bell crank 18, it is possible to perform control so as to mitigate the impact when reaching the mechanism limit.

(8)

The method for controlling the wheel loader 1 (an example of a work machine) of the present embodiment includes step S31 (an example of a moving step) and step S32 (an example of a storage step). In step S31 (an example of a moving step), the bucket 15 is moved to the tilt end. In step S32, the bell crank angle (an example of posture) at the tilt end of the bell crank 18 is stored. In steps S11 to S20 (an example of a control step), the bucket cylinder 17 is controlled based on the angle (an example of a posture) of the bell crank 18 at the tilt end.

As a result, when the bucket 15 is replaced, it is possible to obtain the maximum value of the bucket 15 easily and detect the tilt.

(9)

In the method for controlling the wheel loader 1 (an example of a work machine) of the present embodiment, in steps S11 to S26 (an example of a control step), the drive command (an example of a target cylinder drive command) is given based on either the first tilt limit flow rate (an example of a first cylinder drive command) or the first dump limit flow rate (an example of a first cylinder drive command) based on differences between the bell crank angle (an example of the posture) of the bell crank 18, and the maximum value (an example of the limit posture) or the minimum value (an example of the limit posture) of the bell crank angle of the bell crank 18, and the second tilt limit flow rate (an example of a second cylinder drive command) or the second dump limit flow rate (an example of a second cylinder drive command) based on differences between the cylinder length, and the maximum value (an example of the end position) or the minimum value (an example of the end position) of the cylinder length of the bucket cylinder 17.

In this way, by setting the limit flow rate based on the maximum value and the minimum value of the bell crank angle, it is possible to perform mitigation control when the bucket 15 reaches the tilt end and the dump end due to the mechanism limit of the link mechanism of the work implement 3.

Further, by setting the limit flow rate based on the maximum value and the minimum value of the cylinder length of the bucket cylinder 17, it is possible to perform mitigation control when the bucket 15 reaches the tilt end and the dump end due to the cylinder length of work implement 3.

Other Embodiments

Although one embodiment of the present invention has been described above, the present invention is not limited to the above embodiment, and various modifications can be made without departing from the gist of the invention.

(A)

In work implement 3 of the above embodiment, the attachment part 18*a* of the bell crank 18 to the bucket cylinder 17 is arranged on the cab 5 side in the rotation direction with respect to the attachment part 18*b* of the bucket 15 to the rod 18*f*, but this is not the only option. The attachment part of the bell crank 18 to the rod 18*f* of the bucket 15 may be arranged on the cab 5 side with respect to the attachment part to the bucket cylinder 17.

(B)

In work implement 3 of the above embodiment, the bucket 15 rotates to the tilt side when the bucket cylinder 17 extends, and the bucket 15 rotates to the dump side when the bucket cylinder 17 contracts, but this is not the only option. The bucket 15 may rotates to the dump side when the bucket cylinder 17 extends, and the bucket 15 may rotate to the tilt side when the bucket cylinder 17 contracts.

(C)

In the above embodiment, both the tilt end and the dump end are detected by using the angle of the bell crank 18, but for example, only the tilt end may be detected. Regarding the dump end, the dump end may be detected only by the stroke length of the bucket cylinder 17. This is because the dump end does not change even if the bucket 15 is replaced, so that it only needs to be set once, and it is not necessary to perform the above-mentioned calibration every time the bucket is replaced.

(D)

In the above embodiment, the tilt/dump determination section 75 determines whether the bucket 15 is moved to the tilt side or the dump side, and the bell crank limit flow rate calculation section 71 determines one of the first tilt side limit flow rate and the first dump side limit flow rate, and the cylinder limit flow rate calculation section 72 determines one of the second tilt side limit flow rate and the second dump side limit flow rate, but this is not the only option. For example, the bell crank limit flow rate calculation section 71 may detect the difference between the bell crank angle detected by the bell crank angle sensor 55 and a value close to the bell crank angle among the maximum value and the minimum value, and may calculate the limit flow rate based on the bell crank angle by using the difference. Similarly, the cylinder limit flow rate calculation section 72 may detect the difference between the calculated stroke and a value close to the calculated stroke among the maximum value and the minimum value, and may calculate the limit flow rate based on the cylinder length by using the difference.

Further, for example, without determining whether the bucket 15 is moved to the tilt side or the dump side, all of the first tilt side limit flow rate, the first dump side limit flow rate, the second tilt side limit flow rate, and the second dump limit flow rate may be determined, the one with the largest limit flow rate may be adopted.

(E)

In the above embodiment, the tilt end and the dump end due to the mechanical limit of work implement 3 are detected based on the angle of the bell crank 18, and the tilt end and the dump end due to the cylinder length of the bucket cylinder 17 are detected based on the stroke length. However, only the tilt end and the dump end due to the mechanical limit where the impact is strong in general may be detected.

(F)

In the above embodiment, for example, a potentiometer is used as the bell crank angle sensor 55, but this is not the only option. An IMU (Inertial measurement unit) or the like may be used.

(G)

In the above embodiment, the stroke of the bucket cylinder 17 is obtained based on the detected values of the boom angle sensor 54 and the bell crank angle sensor 55, but this is not the only option, and the cylinder length may be directly measured.

(H)

In the above embodiment, the angle of the bell crank shown in FIG. 2 is used as an example of the posture of the bell crank 18 with respect to the boom 14, but if the posture of the bell crank 18 with respect to the boom 14 is uniquely determined, it is not limited to θb in FIG. 2, and a combination of a plurality of angles may be used.

According to the present invention, it is possible to provide the work machine and the method for controlling the work machine capable of mitigating an impact at a tilt end or a dump end without considering a boom angle.

The invention claimed is:

1. A work machine comprising:

a boom;

a work tool configured to drive with respect to the boom;

a cylinder configured to drive the work tool;

a sub-link attached to the boom, the sub-link being configured to transmit driving force of the cylinder to the work tool;

an operating lever configured to operate the work tool;

a sensor configured to detect a stroke of the cylinder; and a controller including a processor, the controller being configured to control the cylinder based on an operating amount of the operating lever and limit a flow rate of hydraulic fluid supplied to the cylinder based on a posture of the sub-link with respect to the boom, the controller being further configured to calculate a first flow rate limit amount based on a difference between the posture of the sub-link and a limit posture of the sub-link, the limit posture corresponding to a mechanism limit of the sub-link that is different from an end position of the cylinder, calculate a second flow rate limit amount based on a difference between the stroke and the end position of the cylinder, determine a larger of the first flow rate limit amount and the second flow rate limit amount, set the larger of the first flow rate limit amount and the second flow rate limit amount as a flow rate limit amount, and control the flow rate of the hydraulic fluid supplied to the cylinder such that the flow rate does not exceed a difference between a maximum flow rate and the flow rate limit amount.

2. The work machine according to claim 1, wherein one end of the cylinder is rotatably attached to a vehicle body of the work machine at a first attachment part, the sub-link is rotatably attached to another end of the cylinder at a second attachment part, the sub-link is rotatably attached to the work tool at a third attachment part, and the sub-link is rotatably attached to the boom at a fourth attachment part between the second attachment part and the third attachment part.

3. The work machine according to claim 2, wherein the work tool is rotatably attached to the boom at a fifth attachment part, the boom is rotatably attached to the vehicle body at a sixth attachment part, and the posture of the sub-link includes an angle formed by a line connecting the second attachment part and the fourth attachment part and a line connecting the fifth attachment part and the sixth attachment part.

4. The work machine according to claim 1, wherein the controller is further configured to set a target cylinder drive command such that the flow rate of the hydraulic fluid does not exceed the difference when a flow rate of the hydraulic fluid based on the operating amount of the operating lever exceeds the limit flow rate, and set the target cylinder drive command such that the flow rate of the hydraulic fluid is based on the operating amount of the operating lever when the flow rate of the hydraulic fluid based on operation of the operating lever does not exceed the limit flow rate.

5. A work machine comprising:

a boom;

a work tool configured to drive with respect to the boom;

a cylinder configured to drive the work tool;

a sub-link attached to the boom, the sub-link being configured to transmit driving force of the cylinder to the work tool;

a sensor configured to detect a stroke of the cylinder; and a controller including a processor, the controller being configured to control the cylinder based on a posture of the sub-link with respect to the boom, the controller being further configured to calculate a first cylinder drive command and a second cylinder drive command and issue the larger of the first cylinder drive command and the second cylinder drive command as a target cylinder drive command, the first cylinder drive command being based on a difference between the posture of the sub-link and a limit posture of the sub-link and a second cylinder drive command being based on a difference between the stroke and an end position of the cylinder, the end position of the cylinder being a maximum value of the stroke of the cylinder or a minimum value of the stroke of the cylinder, and the limit posture of the sub-link being a posture of the sub-link at a tilt end of the work tool or a posture of the sub-link at a dump end of the work tool.

6. The work machine according to claim 1, wherein the work machine is an articulated wheel loader in which a front frame and a rear frame are connected.

7. A method for controlling a work machine having a boom, a work tool, a sub-link, and a cylinder arranged to drive the work tool with respect to the boom, the method comprising:

controlling the cylinder based on a posture of the sub-link with respect to the boom, the sub-link being configured to transmit a driving force of the cylinder to the work tool to drive the work tool with respect to the boom, the controlling the cylinder including calculating a first flow rate limit amount based on a difference between the posture of the sub-link and a limit posture of the sub-link, the limit posture corresponding to a mechanism limit of the sub-link that is different from an end position of the cylinder, calculating a second flow rate limit amount based on a difference between the stroke and the end position of the cylinder, determining a larger of the first flow rate limit amount and the second flow rate limit amount, setting the larger of the first flow rate limit amount and the second flow rate limit amount as a flow rate limit amount, and controlling the flow rate of the hydraulic fluid supplied to the cylinder such that the flow rate does not exceed a difference between a maximum flow rate and the flow rate limit amount.

8. The method for controlling the work machine according to claim 7, further comprising:

moving the work tool to a tilt end;

determining the posture of the sub-link at the tilt end; and using the posture of the sub-link at the tilt end as the limit posture of the sub-link.

* * * * *